United States Patent [19]

Hoffmann

[11] Patent Number: 4,551,083

[45] Date of Patent: Nov. 5, 1985

[54] DUAL ROTOR GEAR ASSEMBLY FOR TROCHOIDAL ROTARY DEVICE

[75] Inventor: Ralph M. Hoffmann, Eden Prairie, Minn.

[73] Assignee: Trochoid Power Corporation, Eden Prairie, Minn.

[21] Appl. No.: 612,419

[22] Filed: May 21, 1984

[51] Int. Cl.[4] ..... F01C 1/22; F01C 17/02

[52] U.S. Cl. ..... 418/61 A

[58] Field of Search ..... 418/61 A; 123/242

[56] References Cited

U.S. PATENT DOCUMENTS

| | | | |
|---|---|---|---|
| 3,208,666 | 9/1965 | Fezer et al. | 418/61 A X |
| 3,286,698 | 11/1966 | Peras | 123/242 |
| 3,413,961 | 12/1968 | Keylwert | 123/242 |
| 3,744,941 | 7/1973 | Nestor | 418/61 A |
| 3,875,905 | 4/1975 | Duquette | 418/61 A |
| 3,967,594 | 7/1976 | Campbell | 123/242 |
| 4,308,002 | 12/1981 | Di Stefano | 418/61 A X |
| 4,410,299 | 10/1983 | Shimoyama | 418/61 A X |

FOREIGN PATENT DOCUMENTS

| | | | |
|---|---|---|---|
| 1230261 | 12/1966 | Fed. Rep. of Germany | 418/61 A |
| 1451777 | 6/1969 | Fed. Rep. of Germany | 418/61 A |
| 977395 | 12/1964 | United Kingdom | 123/242 |
| 994432 | 6/1965 | United Kingdom | 418/61 A |

*Primary Examiner*—William L. Freeh
*Assistant Examiner*—Paul F. Neils
*Attorney, Agent, or Firm*—Hill, Van Santen, Steadman & Simpson

[57] ABSTRACT

A timing gear assembly for a trochoidal rotary device comprises a dual set of like timing gear systems provided on opposite lateral sides of the rotor to prevent rotor wobble. The pair of timing gear systems are in balance and equally loaded in support of the rotor at all times during rotor movement; and the opposed timing gear systems are circumferentially offset relative to one another, either by virtue of relative circumferential displacement of the pinion gears or ring gears or both.

8 Claims, 2 Drawing Figures

DUAL ROTOR GEAR ASSEMBLY FOR TROCHOIDAL ROTARY DEVICE

BACKGROUND OF THE INVENTION

The present invention relates to a timing gear assembly for a trochoidal rotary expansible chamber device having a planetating rotor inwhich a dual set of timing gears are provided on opposite sides of the rotor to prevent rotor wobble.

Trochoidal rotary expansible chamber devices, such as the Wankel or epitrochoidal rotary machines, generally comprise a housing defining a cavity in which is mounted a rotor rotatable in a planetating fashion. Trochoidal rotary devices may be divided into two groups referred to as inner envelope and outer envelope types. In an inner envelope configuration, the profile of the housing cavity is the trochoidal curve and the peripheral profile of the rotor is the inner envelope of the trochoidal curve. In an outer envelope device, the rotor profile is the trochoidal curve and the housing cavity profile is the outer envelope of that curve. Variable spaces formed between the facing peripheral surfaces of the rotor and the housing cavity serve as working chambers for fluid compression or expansion.

A chronic problem in trochoidal devices is rotor wobble. Rotor wobble is the result of cantilevering of the rotor in its planetating movement and is especially pronounced in outer envelope devices in which a pinion timing gear connected to the rotor moves about a ring gear. Rotor wobble is likely the result of the radial demeshing force applied against the beveled surface of the pinion gear teeth by its movement about the ring gear.

Rotor wobble can cause power loss and working chamber inefficiencies. Rotor wobble primarily causes the peripheral edges of the rotor to dig into the sidewalls, causing material degradation and premature failure of the device.

This wobbling action causes uneven seal wear in the rotor housing, which is more pronounced with greater seal area and rotor size, and results in lower seal life for the trochoidal device.

SUMMARY OF THE INVENTION

A rotary trochoidal device, particularly an outer envelope device, is provided with a dual timing gear arrangement in connection with the rotor. The timing gear systems are functionally connected to opposed lateral sides of the rotor to support the rotor against wobbling. A significant feature of the invention is the opposed timing gears on either side of the rotor are not necessarily, and in fact are not expected to be, mirror images of one another. That is, the opposed rotor pinion gears and/or the opposed ring gears are circumferentially displaced relative to one another on opposite sides of the rotor so as to not be in radial alignment with one another. This allows fastening the pinion gears to the rotor without regard to their relative circumferential tooth spacing, and subsequently allowing adjustment of the internal ring gears such that equal gear-tooth loading occurs which is a prerequisite of eliminating rotor wobble. Another significant feature of the invention is that the dual opposed timing gear systems simultaneously carry identical loads at all times.

Simultaneous equal loading and relative circumferential displacement of opposed timing gears across the rotor is effected by randomly fixing the pinion gear set onto the rotor, and then timing the ring gears about the pinions before fixing the ring gears in the rotor housing. This can be done using fixtures or can better be done upon assembly in the trochoidal device by the use of appropriate instrumentation and gauges. This timing procedure enables the dual timing gear systems to establish an offset interrelationship between the timing gears of the opposite set which compensates for assembly and manufacturing tolerances in the shaft, gears, and eccentric to assure the balanced equal loading of the timing gear systems.

DESCRIPTION OF THE PREFERRED EMBODIMENT

Figure 1:
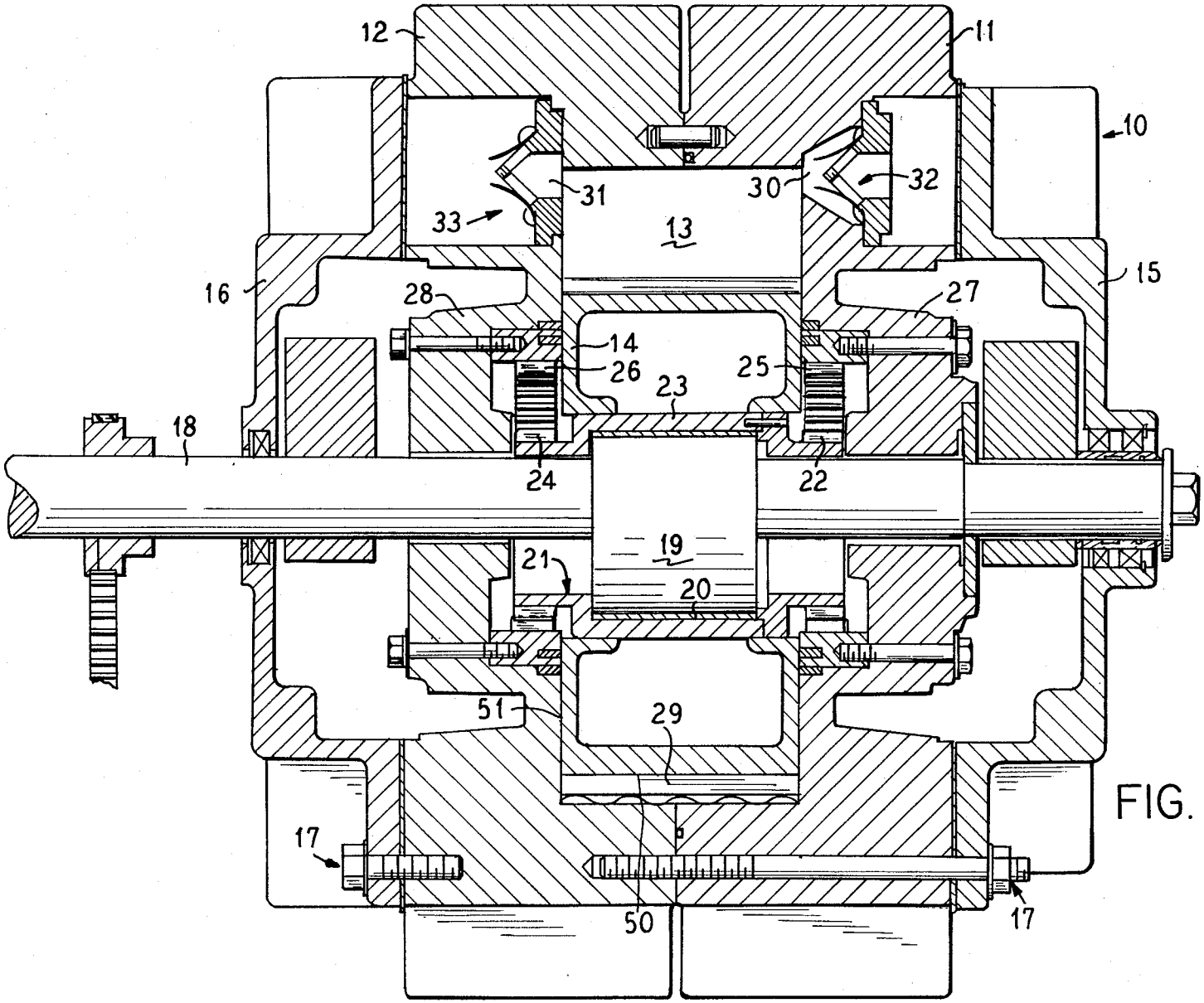
FIG. 1 is a side elevational cross-sectional view of an outer envelope epitrochoidal compressor utilizing the dual timing gear arrangement of the present invention.

As those skilled in the art will recognize, the terms "inner envelope" and "outer envelope" refer to the manner in which working member profiles are generated for trochoidal rotary expansible chamber devices. Typical forms of trochoidal devices have fixed housing members for containing rotors traveling in a planetating rotary fashion therein. The known forms have either inner rotors in the form of epitrochoid or hypotrochoid curves or they have inner rotors in the form of envelopes derived from those curves. The designation "epitrochoid" and "hypotrochoid" refer to the manner in which a trochoidal machine's profile curves are generated, such as described in U.S. Pat. No. 3,117,561.

Inner envelope and outer envelope trochoidal profiles can take many configurations. Spaces formed between the trochoidal working member profile and the peripheral wall surface of the envelope working member serve to define fluid working chambers, such as may be used for fluid expansion or compression processes. Although it is conventional to maintain the rotor housing stationary while the rotor moves within the housing cavity, it is also known to fix the rotor and driveshaft and rotate the rotor housing, such as disclosed in U.S. Pat. No. 3,091,386.

The Figure shows an outer envelope trochoidal rotary device 10 based upon a three-lobed epitrochoid curve which functions, for example purposes, as a compressor. The device 10 includes a two-piece rotor housing 11, 12 defining a profiled cavity 13 in which an epitrochoidal rotor 14 is mounted for movement. A pair of end plates 15 and 16 are respectively attached to the exterior sides of the housing pieces 11, 12 via suitable bolt means 17.

A single driven shaft 18 extends axially through the housing 11, 12 and is supported for rotation on suitable journal bearings in the end plates 15 and 16. The outer envelope profile of the housing cavity 13 is symmetrically arranged about a first axis which is the axial centerline of the driveshaft 18. The driveshaft is formed with an eccentric lobe 19 which is concentric about a second axis radially offset from the first axis and about which the rotor 14 is symmetrically arranged. The rotor 14 planetates about the second axis on a sleeve bearing 20.

Attached to the rotor 14, for rotation therewith on the sleeve bearing 20, is a dual opposed pinion gear element 21 formed by a unitary support ring 23 and first radial pinion gear 24 extending adjacent one lateral side of the rotor 14 and a like separate second radial pinion gear 22 disposed adjacent the opposed lateral side of the rotor 14. The second pinion gear 22 is adapted to be selectively dowel pinned, as desired, to the adjacent edge of the support ring 23. The pinion gears 24 and 22 are each concentric about the second axis. The pinion gear element 21 can be conventionally fastened to the rotor by a shrink-fit operation.

The pinion gears 22 and 24 are operatively associated with corresponding like ring gears 25 and 26 bolted to cover plate portions 27 and 28 formed on the rotor housing pieces 11 and 12. The ring gears 25 and 26 are each concentric about the first axis. These pinion and ring gears thus serve as a dual timing gear arrangement for the trochoidal device 10 in accordance with the invention.

The housing cavity 13 and the rotor periphery serve to define variable volume working chambers corresponding to the lobe portions of the cavity 13 upon movement of the rotor 14 in the housing 11, 12. The working chambers are suitably sealably separated from one another by conventional-type apex seals 29, disposed at each of the cavity profile apices, and other conventional working chamber seal assemblies, such as arcuate seals disposed along opposed sides of the rotor periphery and mounted in rotor sidewall areas.

Each working chamber is provided with respective inlet and outlet ports 30 and 31 formed in the housing portions 11 and 12 having corresponding intake and discharge valve means 32 and 33, which may be in the form of spring flap valves, which permit the working chambers to receive, compress, and exhaust working fluid during operation of the compressor 10. The inlet and discharge ports may be located in the housing sidewalls adjacent to the rotor sides or in the outer envelope surface containing the seals 29. Suitable fluid flow conducting means (not shown) serve to conduct fluid, such as air, to pass to the inlet ports 30 through the working chambers and be discharged as compressed fluid through the outlet ports 31.

The opposed timing gear systems 24, 26 and 22, 25 on either side of the rotor 14 are not necessarily, and in fact are not expected to be, mirror images of one another. In accordance with the invention, it is intended that the opposed ring gears 25 and 26 are circumferentially displaced relative to one another so as to not be in radial alignment with one another about their common axis of rotation to offset assembly or machining tolerances, such as accumulated tooth-runout or tooth placement. This opposed timing gear relative displacement is the result of timing the pinion gears, or alternatively the ring gears, of the dual timing gear arrangement to assure simultaneous equal loading of the opposed timing gear systems 22, 25 and 24, 26 at all times during rotor movement. Since the opposed timing gear systems are load balanced, the rotor operation is free of deleterious wobble. In addition to the improvement in rotor seal wear life as the result of wobble-free rotor operation, there is no longer any need to oversize the lateral width of the rotor pinion gear teeth relative to the width dimension of the corresponding ring gear teeth which is a conventional practice to compensate for heretofore typical rotor wobbling. Also, the division of loading between the dual timing gear systems of the present invention enables one to reduce the teeth width of the ring and pinion gears in the individual timing gear system 24, 26 or 22, 25 by as much as a factor of about one-half relative to the conventional teeth width dimensions for a typical single unit timing gear arrangement used in a comparable trochoidal rotary device. Thus, there is afforded spatial savings with the trochoidal device 10 on one or the other sides of the rotor 14.

To afford balanced timing of the pinion and ring timing gear systems 24, 26 and 22, 25 in the present invention to achieve the balanced loading, the assembler places an indicator line on the periphery 50 of the rotor 14. The dual pinion gears 24 and 25 are dowel pinned together by randomly affixing the pinion gear 22 to the supporting ring 23 and attaching the dual pinion gear element 21 to the rotor 14, such that both pinion gears 24 and 22 are concentric about the rotational axis of the eccentric 19, ie. the second axis. The rotor assembly is mounted on the eccentric 19 which is fixed to the shaft 18. The shaft is rotated until the eccentric 19 is at a top-dead-center position at which the indicator line on the rotor 14 is at a "maximum" disposition. A matching indicator mark, coincident or aligned with the indicator line on the rotor 14, is then placed on the housing cavity profile to record this "maximum" disposition point.

The like ring gears 25 and 26 and their housing supports 27 and 28 are such that the ring gears will be concentric about the shaft axis, ie. the first axis. Either of the ring gears, say 25, already engaged with its corresponding pinion gear, here 22, is then rotated until the indicator line on the rotor 14 is again at its "maximum" disposition point. This ring gear, 25, is then fixed in this orientation relative to the pinion gear 22 to the housing support, ie. cover plate portion 27.

The next thing to do is to place a movement indicator on the sidewall 51 of rotor 14. This sidewall is the side opposite the gear originally chosen for the first stage of the timing, namely that facing gear 25. The shaft is then freely rotated, and the other ring gear 26 is circumferentially adjusted such that the reading on the indicator at sidewall 51 is minimized as to the magnitude of its indication. Typical experience is that the rotor can be set with the indicator reading at sidewall 51 to be as little as plus or minus 0.001, using sleeve bearings 20 to support the rotor. This other ring gear 26, after being so adjusted, is then fixed in this orientation relative to the pinion gear 24 to the housing support; ie. cover plate 28.

Figure 2:
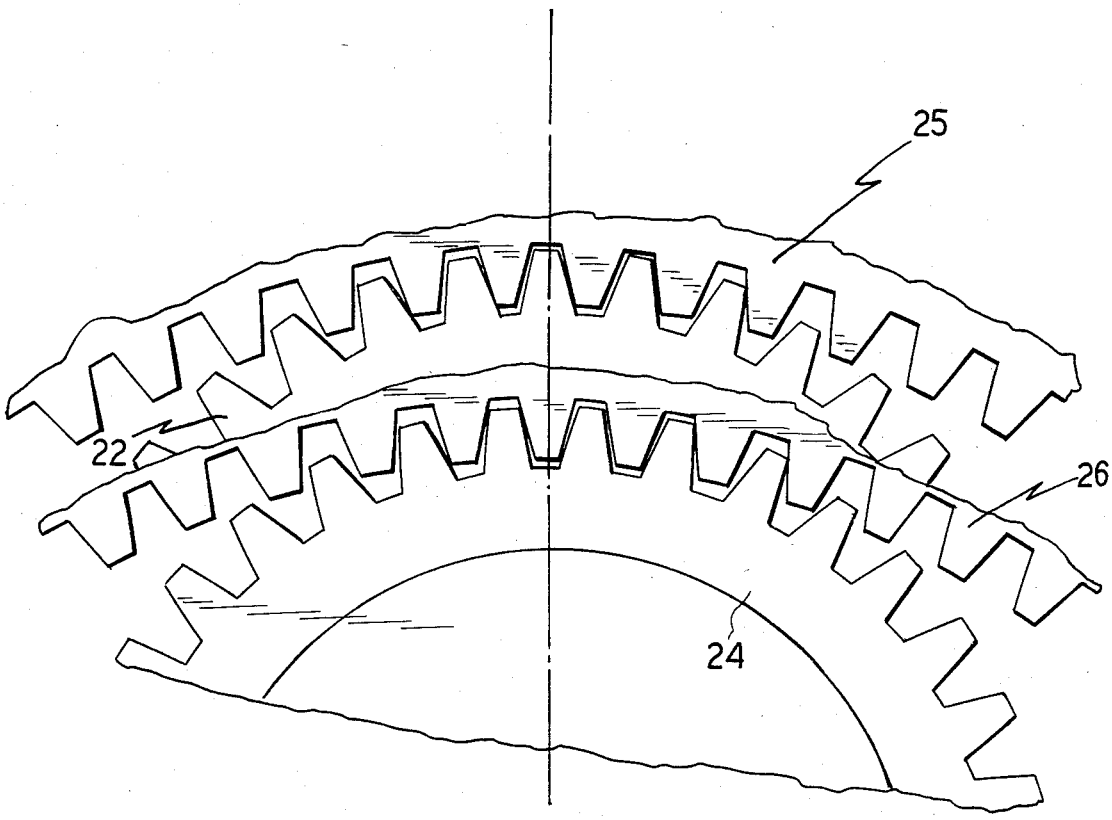
FIG. 2 is a schematic front elevational view depicting the relative disposition of the opposed timing gears during movement of the rotor.

As a result of this timing procedure for the dual timing gear systems, it must be expected that the opposed timing gears, either the pinions 22 and 24 or the rings 25 and 26 or both, are not oriented so as to be mirror images of one another, but rather are circumferentially displaced relative to one another so as to not be in radial alignment with one another. This circumferential offset of radial alignment for both the pinions and the rings of the dual timing gears is illustrated in FIG. 2. Nevertheless, the dual timing gear systems are now set as a result of the timing procedure so that rotor wobble is prevented and an equal load is carried by both of the timing gear systems at all times. This is because the timing procedure enables the dual timing gear systems to establish an offset interrelationship between the corresponding timing gears of the opposite sets which compensates for assembly and manufacturing tolerances in the shaft, gears, and eccentric to obtain this balanced equal loading.

Although various minor modifications may be suggested by those versed in the art, it should be understood that I wish to embody within the scope of the patent warranted hereon all such modifications as reasonably and properly come within the scope of my contribution to the art.

I claim as my invention:

1. A trochoidal rotary device comprising a rotor disposed for planetating movement on a shaft, said rotor having a symmetrical peripheral profile surface, a housing having a peripheral wall surface defining a cavity for containing said rotor, an eccentric mounted on said shaft and supporting said rotor for movement in said cavity on said shaft, and working chambers defined in said cavity between said rotor peripheral profile surface and said housing peripheral wall surface, the improvement comprising that the rotor movement is substantially free of lateral wobble in that said rotor is disposed for movement in said cavity on said shaft by a like pair of timing gear systems engaged with said rotor and disposed on opposed lateral sides of said rotor, each said timing gear system comprising a pinion gear and a ring gear, said pair of timing gear systems being equally loaded at all times during movement of said rotor and circumferentially offset relative to one another so as to not be in radial alignment with one another.

2. The trochoidal device of claim 1, wherein said housing is formed of two separate housing halves releasably fastened together in a plane extending through said cavity.

3. The trochoidal device of claim 1, wherein said peripheral wall surface defining said cavity is the outer envelope of a trochoidal curve, said trochoidal curve defining the peripheral profile surface of said rotor.

4. The trochoidal rotary device of claim 3, wherein said shaft is driven and said device is a compressor with intake and discharge valve means connected to each of said working chambers.

5. The trochoidal rotary device of claim 1, wherein said corresponding pinion gears of said pair of timing gear systems are circumferentially displaced relative to one another so as to not be in radial aglignment with one another.

6. The trochoidal device of claim 5, wherein said pinion gears are fixed to said rotor and concentric about a rotational axis of said eccentric and said ring gears are fixed to sidewalls of said housing and concentric about a rotational axis of said shaft.

7. The trochoidal rotary device of claim 1, wherein said corresponding ring gears of said pair of timing gear systems are circumferentially displaced relative to one another so as to not be in radial alignment with one another.

8. The trochoidal rotary device of claim 7, wherein said pinion gears are fixed to said rotor and concentric about a rotational axis of said eccentric and said ring gears are fixed to sidewalls of said housing and concentric about a rotational axis of said shaft.

* * * * *